US006583408B2

(12) United States Patent
Smith et al.

(10) Patent No.: US 6,583,408 B2
(45) Date of Patent: Jun. 24, 2003

(54) IONIZATION SOURCE UTILIZING A JET DISTURBER IN COMBINATION WITH AN ION FUNNEL AND METHOD OF OPERATION

(75) Inventors: Richard D. Smith, Richland, WA (US); Taeman Kim, Richland, WA (US); Keqi Tang, Richland, WA (US); Harold R. Udseth, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 138 days.

(21) Appl. No.: 09/860,721

(22) Filed: May 18, 2001

(65) Prior Publication Data

US 2002/0185606 A1 Dec. 12, 2002

(51) Int. Cl.[7] ..... H01J 49/04
(52) U.S. Cl. ..... 250/288; 250/396 R; 250/292
(58) Field of Search ..... 250/288, 396 R, 250/292

(56) References Cited

U.S. PATENT DOCUMENTS 6,107,628 A * 8/2000 Smith et al. ..... 250/292
6,417,511 B1 * 7/2002 Russ et al. ..... 250/292
2002/0063210 A1 * 5/2002 Bateman et al. ..... 250/288

FOREIGN PATENT DOCUMENTS

WO WO 9749111 A1 * 12/1997 ..... H01J/29/46

* cited by examiner

*Primary Examiner*—Jack Berman
(74) *Attorney, Agent, or Firm*—Stephen R. May; Douglas E. McKinley, Jr.

(57) ABSTRACT

A jet disturber used in combination with an ion funnel to focus ions and other charged particles generated at or near atmospheric pressure into a relatively low pressure region, which allows increased conductance of the ions and other charged particles. The jet disturber is positioned within an ion funnel and may be interfaced with a multi-capillary inlet juxtaposed between an ion source and the interior of an instrument maintained at near atmospheric pressure. The invention finds particular advantages when deployed to improve the ion transmission between an electrospray ionization source and the first vacuum stage of a mass spectrometer.

10 Claims, 7 Drawing Sheets

Reserpine 100 pg/$\mu$l

Reserpine 10 pg/$\mu$l

IONIZATION SOURCE UTILIZING A JET DISTURBER IN COMBINATION WITH AN ION FUNNEL AND METHOD OF OPERATION

STATEMENT REGARDING FEDERALLY SPONSORED RESEARCH OR DEVELOPMENT

This invention was made with Government support under Contract DE-AC06-76RLO 1830 awarded by the U.S. Department of Energy. The Government has certain rights in the invention.

CROSS REFERENCE TO RELATED APPLICATIONS

Not Applicable

FIELD OF THE INVENTION

The present invention relates generally to a method and apparatus for directing or focusing dispersed charged particles into a low pressure apparatus. More specifically, the invention utilizes a jet disturber used in combination with an ion funnel to focus ions and other charged particles generated at or near atmospheric pressure into a relatively low pressure region, which allows increased conductance of ions and other charged particles into the device. The invention may further make use of a multi-capillary inlet to further enhance the conductance of such charged particles.

BACKGROUND OF THE INVENTION

A great variety of scientific inquiry is confronted with the challenge of identifying the atomic structure or composition of particular substances. To assist in this identification, a variety of schemes have arisen which require the ionization of the particular substances of interest. Many of these analytical techniques, as well as the other industrial uses of charged particles, are carried out under conditions of high vacuum. However, many ion sources operate at or near atmospheric pressures. Thus, those skilled in the art are continually confronted with challenges associated with transporting ions and other charged particles generated at atmospheric or near atmospheric pressures into regions maintained under high vacuum.

An illustrative example of this general problem is presented in the use of electrospray ionization when combined with mass spectrometry as an analytical technique. Electrospray ion sources (which broadly includes, but is not limited to, nano electrosprays conventional electrosprays, microelectrospray, and nebulizing gas assisted electrospray) are widely used with mass spectrometry for sample analysis, for example in biological research. For m/z analysis, ions are typically created at atmospheric pressure by the electrospray ion source and are then transported to the high vacuum region of a mass spectrometer through a capillary inlet that penetrates the first chamber of the mass spectrometer. A differential pumping system involving several stages for stepwise pressure reduction is commonly used to achieve the vacuum conditions conventionally utilized in m/z analysis within the mass spectrometer, and the major design issues are generally related to optimizing overall ion transmission efficiencies.

Improved transmission efficiencies in the intermediate vacuum stages have been achieved by using the recently developed RF ion funnel at higher interface pressures (~1 to 10 Torr) and RF multi-pole ion guides with buffer gas cooling at lower interface pressures as more fully described in Shaffer, S. A.; Tang, K.; Anderson, G. A.; Prior, D. C.; Udseth, H. R.; Smith, R. D., *Rapid Commun. Mass Spectrom.* 1997, 11, 1813–1817; Shaffer, S. A.; Prior, D. C.; Anderson, G. A.; Udseth, H. R. and Smith, R. D. *Anal. Chem.* 1998, 70, 4111–4119; and Douglas, D. J.; French, J. B., *J. Am. Soc. Mass Spectrom.* 1992, 3, 398–408, and U.S. Pat. No. 6,107,628 entitled Method and Apparatus for Directing Ions and other Charged Particles Generated at Near Atmospheric Pressures into a Region under Vacuum, the entire contents of each of which are herein incorporated into this specification by this reference.

In co-pending U.S. patent application Ser. No. 09/860,727, filed May 18, 2001,

IMPROVED IONIZATION SOURCE UTILIZING A MULTI-CAPILLARY INLET AND METHOD OF OPERATION the entire contents of which are incorporated herein by this reference, a new interface having higher ion transmission efficiency compared to conventional interface designs is described. This interface, known as a multicapillary inlet, uses an array of capillaries to increase the gas throughput (i.e. the ion transmission) without sacrificing droplet desolvation efficiency and an electro-dynamic ion funnel for ion focusing into the next vacuum stage. To maintain the operating pressure of the ion funnel constant with the multi capillary inlet, the pumping for the first chamber (ion funnel chamber) is typically increased proportional to the conductance increase of the multicapillary inlet. It has been found that the directed gas stream from the larger conductance inlet was not completely dispersed, but retained some directed flow to the exit of the ion funnel. When the gas molecules with entrained ions enter into the first vacuum stage, the gas experiences an adiabatic expansion and forms a free jet. The expansion is surrounded by a concentric barrel shock and terminated by a perpendicular shock known as the Mach disc. In the expansion region, the gas molecules move in straight streamlines originating in the inlet. The region downstream of the Mach disc is known to have complex behavior. Far away from the inlet, the gas molecules move at random. There is a transition region where the directed motion changes into random motion in the region downstream of the Mach disc. In the ion funnel interface with the multi-capillary inlet, the transition region extends beyond the bottom of the ion funnel, and thus more gas is transferred to the second vacuum stage by the directed flow than with a single capillary inlet having a smaller conductance. Therefore, the pumping requirement in the second vacuum stage increases with the increase of the number of capillaries even though the ion funnel chamber is operated at the same pressure. Thus, an even higher vacuum pumping speed is required in the first stage (the ion funnel chamber) to maintain the second vacuum stage pressure in an acceptable range.

Thus, there exists a need for methods and apparatus that allow a reduction in the required pumping speed.

SUMMARY OF THE INVENTION

Accordingly, it is an object of the invention in one of its aspects to provide a method for providing an ion or charged particle source in a pressure region at near atmospheric pressures. As used herein, "near atmospheric" pressures are defined as between $10^{-1}$ millibar and 1 bar. Also as used herein, the charged particles are defined as being smaller than one billion AMUs. The focusing of the present invention is accomplished by providing an apparatus, hereinafter referred to as a "jet disturber", which is positioned within an ion funnel. Most generally, a jet disturber may be any form of matter placed within the interior of an ion funnel that disperses the gas flow through the ion funnel. For example, in one preferred embodiment of the present invention, the jet disturber is simply a metal disc, mounted on a cross of two wires within the interior of an ion funnel perpendicular to the gas flow through the ion funnel. As will be recognized by those having skill in the art, a great variety of techniques and methods for placing an object within the interior of the ion funnel are possible, and any particular configuration that maintains any such object in such a manner should be construed as falling within the scope of the present invention.

While the present invention should be broadly construed to include any application wherein a jet disturber is used in conjunction with an ion funnel, it finds particular advantages when deployed to improve the ion transmission between an ESI source and the first vacuum stage of a mass spectrometer, and finds its greatest advantages when deployed in conjunction with a multicapillary inlet to introduce ions and other charged particles into a mass spectrometer. When deployed in this fashion, the jet disturber described herein has been demonstrated to provide greatly enhanced ion conductance.

These and other objects of the present invention are accomplished by providing a method for introducing charged particles into a device by first generating ions in a relatively high pressure region external to the device, directing the ions through at least one aperture extending into the device, and further directing the ions through an ion funnel within the interior of the device having a jet disturber positioned within said ion funnel. The present invention is most advantageously deployed when the aperture is provided as a multicapillary inlet, the relatively high pressure region is at between $10^{-1}$ millibar and 1 bar, and the charged particles are generated with an electrospray ion source.

Accordingly, the method of the present invention is carried out with an apparatus for introducing charged particles generated at a relatively high pressure into a device maintained at a relatively low pressure comprising an ion funnel having a jet disturber positioned within said ion funnel. This apparatus is preferably interfaced with a multicapillary inlet extending into the device, whereby charged particles generated in the relatively high pressure region move through the multicapillary inlet and into the ion funnel.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENT(S)

Figure 1:
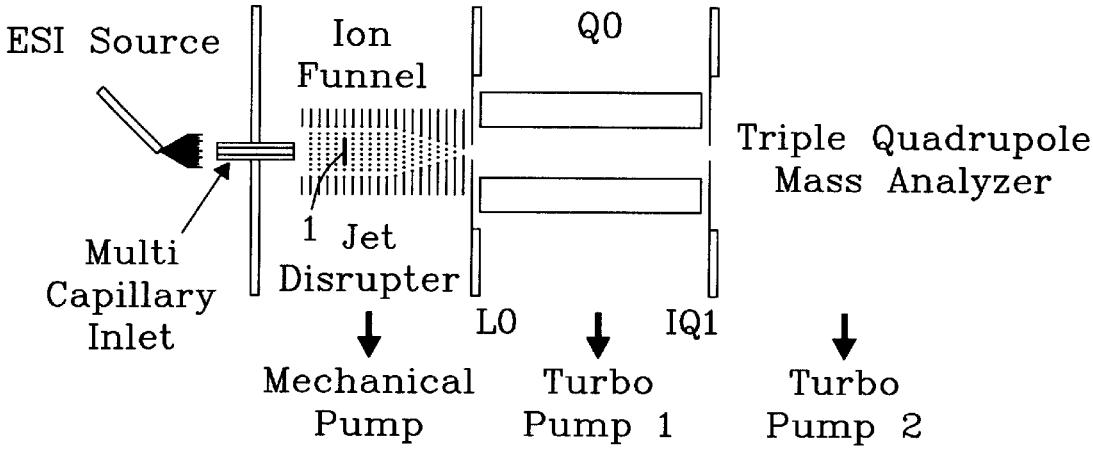
FIG. 1 is a schematic of the multi-capillary inlet and ion funnel interface.

To demonstrate a preferred embodiment of the present invention a two series of experiments were conducted. In the first, the jet disturber effects on the ion transmission efficiency and on the down stream pressure were studied using various combinations of pumps (root blowers) on the first vacuum stage. This configuration is referred to as the high pumping speed arrangement. The second set of experiments determined the relative sensitivity for various inlets to the mass spectrometer using a lower pumping speed mechanical pump on the first vacuum stage. This configuration is referred to as the low pumping speed arrangement. The experiments on ion transmission measurement were conducted using an API 3000 triple quadrupole MS system modified with a custom multi-capillary inlet and an RF ion funnel interface with a jet disturber as shown in FIG. 1. The experiments on the sensitivity enhancement were conducted with both the standard interface of the API 3000 and a modified interface with a custom multi-capillary inlet (or larger orifice inlet) and an RF ion funnel interface with the jet disturber.

The standard ion-spray source of the API 3000 MS was used for all the experiments. The electrospray emitter (i.e., ion source) was tilted by 45 degrees, as in the standard operational configuration for the API 3000. The sample solution flow rate was 5 $\mu$L/min and the potential applied to the electrospray emitter was 4800–6000 V The position of the emitter tip and the nebulizing gas flow rate were adjusted to optimize the ion current after the ion funnel.

Dodecyltrimethylammoniumbromide (DDTMA, $C_{15}H_{34}NBr$) in acetonitrile was used to evaluate ion funnel transmission at relatively low m/z. The DDTMA was purchased from Sigma (St. Louis, Mo.) and the acetonitrile was purchased from Aldrich (Milwaukee, Wis.); both were used without further purification.

Four different samples, 5-fluorouracil (5-FU), minoxidil, taurocholic acid and reserpine were used to evaluate the sensitivity gain with the new interfaces compared to the standard interface of the API 3000. The high concentration (100 pg/$\mu$L–500 pg/$\mu$L) samples were provided by SCIEX and the low concentration ones were prepared by dilution. The solvent composition for respine, minoxidil and taurocholic acid was 22/51/33/1 ethanol/methanol/water/isopropanol+0.1% formic acid. The solvent composition for 5-FU was 50/50 water/acetonitrile+2 mM ammonium acetate. Ethanol and formic acid were purchased from Sigma, and methanol, iso-propanol and acetonitrile from Aldrich, and ammonium acetate from Fluka (Milwaukee, Wis.). They were used without further purification. Water de-ionized to 18.3 MΩ-cm in a nanopure purification system (Barnstead, Dubuque, Iowa) was used throughout.

The heated multi-capillary inlet was fabricated by silver soldering seven 76 mm long stainless steel tubes (Small Parts Inc., Miami Lakes, Fla.) into a hole in a cylindrical stainless steel heating block as described in co pending U.S. application Ser. No. _____, filed _____, IMPROVED IONIZATION SOURCE UTILIZING A MULTI-CAPILLARY INLET AND METHOD OF OPERATION the entire contents of which are incorporated herein by this reference. The same diameter (0.43 mm I.D., 0.64 mm O.D.) was used for all seven tubes. A detailed fabrication method has been reported [10]. The temperature of the capillaries was maintained at ~200° C. The pressure of the ion funnel chamber with the heated seven capillary inlet was similar to that obtained with 0.67 mm orifice inlet. This suggests that the conductance of the seven capillary inlet is about seven times of that of standard orifice inlet.

In the sensitivity evaluation experiments with the low pumping speed system, a 0.67 mm orifice with jet disturber equipped ion funnel was used as one of the configurations. We found that the ion inlet curtain plate opening is an important parameter and used a larger diameter opening curtain plate (6.0 mm) than that of the standard curtain plate (3.0 mm). The theoretical conductance of the larger orifice is about seven times of that of the standard orifice inlet. The interface with the larger inlet and curtain plate opening needed higher curtain gas flow to maintain the outward flow of curtain gas from the curtain plate opening (to provide adequate desolvation in the SCIEX interface design). In these experiments, an external gas flow controller was used to control the curtain gas at a flow rate of 8.3 L/min.

Operation of the multi-capillary inlet required increased first stage pumping. For the high pumping speed configuration, the first vacuum stage was pumped by one of two roots pumps providing nominal pumping speeds of 168 L/sec (Model EH500A system, EDWARDS, Crawley, West Sussex, England) and 84 L/sec (Model WSU251 system, Leybold, Koln, Germany). The pressure in the first vacuum stage was monitored by a Model CMLA-11-001 capacitance manometer (Varian, Lexington, Mass.). The pressure of the first vacuum stage was varied by either switching roots pumps or partly closing butterfly valves installed between the ion funnel chamber and the roots pumps. In these experiments, the maximum pressure of the ion funnel chamber was limited by the operational pressure of the second chamber that was pumped by a Turbo pump (Turbo-V 550, Varian, Lexington, Mass.). The ion funnel chamber pressure was varied from 0.65 Torr (with 168 L/sec pump) to 1.0 Torr (84 L/sec) without the jet disturber, and from 0.65 Torr (with 168 L/sec pump) to 3.0 Torr (84 L/sec, choked) using the jet disturber. In these experiment, the roots pumps were connected using a 3 inch bellows such that the pumping speed at the chamber was less than the nominal values.

Using a jet disturber, it was found that the ion funnel chamber could be maintained at higher pressure while maintaining the second vacuum stage at an acceptable pressure (i.e. for the turbo pump). Therefore we configured a low pumping speed system with the larger inlet using a mechanical pump (22 L/sec, Leybold, D65B) in the first vacuum stage. In the original configuration of the API 3000, a mechanical pump (Leybold, S25B, 8.5 L/sec) was used to pump the first vacuum stage and to back a turbo pump on the second vacuum stage (Q0 chamber). Thus, the first stage pressure and the backing pressure of the turbo pump are identical. In the low pumping speed configuration, that mechanical pump (S25B) was used to back only the turbo pump, and the backing pressure of the turbo pump for the Q0 chamber was significantly lower than that with the standard interface.

The ion funnel shares some characteristics of the RF ring electrode ion beam guide, but incorporates an additional DC potential gradient and uses electrodes of varying diameter. The funnel interface used in this study has three major parts: 1) a front section of the funnel that consists of seven 25.4 mm I.D. rings with 2.5 mm spacing between rings, 2) a middle section that has twenty-four constant 25.4 mm ID rings with 0.5 mm spacing between rings, and 3) a rear section that has forty-five ring electrodes with diameters linearly decreasing from 25.4 to 2.3 mm. The ring electrodes were made of 0.5 mm thick brass sheet and the spaces between the ring electrodes were maintained by inserting pieces of 0.5 mm thick Teflon sheet between them (see FIG. 1*b*). The front and middle sections reduce the gas dynamic effects upon ion confinement, allow improved conductance between inside and outside of the ion funnel for pumping. This reduces the gas-load downstream of the ion funnel, and provides an extended ion residence time to enhance desolvation of charged clusters or droplets. RF voltages of equal but opposite phases were applied between adjacent rings and gradually decreasing DC potentials were applied along the lens stack. The oscillating RF fields near the ring electrodes serve to push ions to the weaker electric field region—towards the central axis region of the ring electrodes. The axial DC field was 16–24 V/cm.

Figure 2:
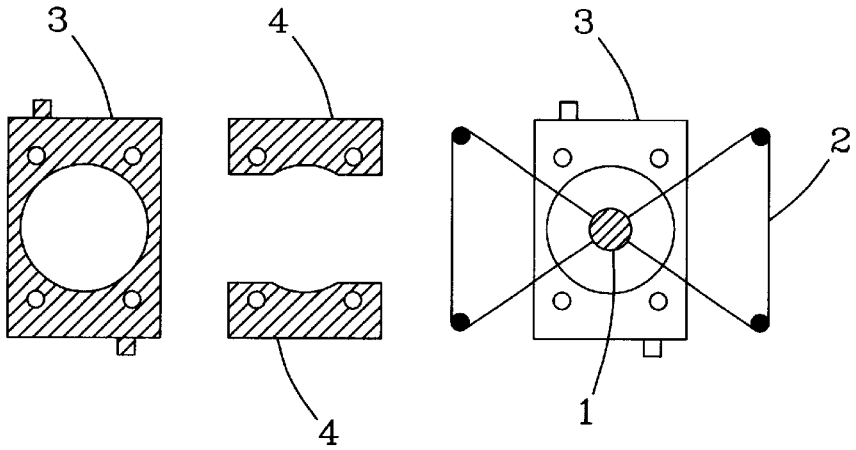
FIG. 2 is a drawing of the parts of the ion funnel with the jet disturber.

The jet disturber aims to disperse the jet stream in the ion funnel while not significantly decreasing the ion current. As shown in FIG. 2, a 9 mm o.d. disk 1 mounted on a cross of two 0.5 mm diameter wires 2 and was suspended between electrodes 3 and with insulators 4 on wither side to insure no contact between wires 2 and electrode 3. This configuration was found to disturb the jet stream effectively, and was used exclusively for these studies. The disturber disk was installed on the center axis of the ion funnel at the end of the front section of the ion funnel (about 22 mm downstream of the multi-capillary inlet) and its surface was perpendicular to the gas jet. A potential about 5V above the adjacent ring electrodes was applied to prevent or reduce ion loss. In a separate experiment, a solid sheet of metal replaced a ring electrode element at the same location as the jet disturber in order to measure the pressure with complete jet dispersion. In these experiments, the first chamber pressure was measured by a pressure gauge installed on the vacuum chamber and the pressure inside the ion funnel (beyond the solid metal sheet) was not directly measured.

For MS/MS experiments with the new interface in the low pumping speed configuration, the collision gas inlet had to be modified to achieve the optimal pressure in the collision induced dissociation (CID) chamber (Q2). In the unmodified API 3000 the collision gas inlet is connected to the interface pumping line (between the Q0 chamber turbo pump and the backing mechanical pump, which also used to pump the first vacuum stage) through a controlling valve. In the low pumping speed configuration, the backing pressure of the second stage turbo pump was too low to feed the CID chamber within the controllable range of the CID gas controller. In these experiments, the CID gas inlet was connected to the ion funnel chamber. With this configuration, when the CID gas control was at its lowest setting, the CID chamber pressure was somewhat higher than optimal but the pressure of the analyzing chamber ($4.3\times10^{-5}$ Torr) was within operational tolerance.

The incoming ion current to the ion funnel from the heated capillary inlet, was measured by summing the currents to the ion funnel, the DC lens after ion funnel, the collisional cooling quadrupole ion guide (Q0) and a conductance limit after Q0 (IQ1). The ion current transmitted into Q0 was determined by measuring the electric current to Q0 and a conductance limit after Q0 (IQ1). During the current measurements, the down stream components were biased to +20 V. Typical bias potentials are given in Table 1, below.

TABLE 1

Typical bias potentials of the ion optical element used for ion transmission measurements.

| Component | Bias (V) |
|---|---|
| Capillary inlet | +120 to +360 |
| Front ion funnel | +120 to +360 |
| Bottom ion funnel | +28 |
| L0 | +24 |
| Q0 | +20 |

The sensitivity was evaluated by comparing the peak heights obtained for the selected standards in MS and MS/MS mode. The bias potentials in the interface region after the ion funnel (Q0, IQ1) were optimized for different configurations and samples while maintaining the resolutions in MS and MS/MS at a unit resolution. The electron multiplier potential and CID energy for MS/MS were maintained constant for each sample for all system configurations. In these experiments, the RF frequency and amplitude of the ion funnel were 1.6 MHz and 100 V (peak to peak), respectively.

The overall sensitivity achievable in a well designed ESI-MS instrument depends upon the ion current that can be effectively transmitted to the analyzer. The useful ion current introduced from the atmospheric pressure ion source depends on a number of factors that include the size of the inlet aperture (e.g. capillary). Larger inlet apertures provide great inlet ion currents, and a multi-capillary inlet design has advantages due to more effective desolvation of analyte ions relative to a single larger diameter inlet. The larger inlets, however, increase the gas load imposed upon the pumping system, and the pressure in higher vacuum regions downstream of the interface become substantially elevated due to the directed nature of the expanding gas jet from the inlet. As shown by these results, it is possible to disperse the gas jet while still preserving efficient ion transmission. Since there are always practical constraints upon pumping speeds, this development provides the basis for a gain in sensitivity.

Figure 3:
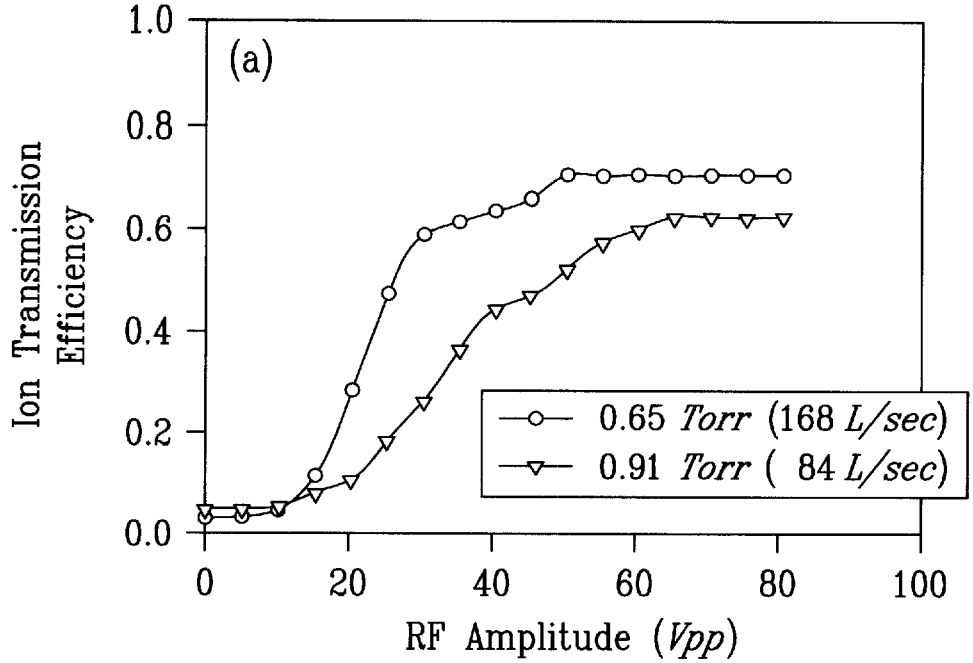
FIG. 3 is a graph showing transmitted ion currents as a function of RF amplitude: (a) without jet disrupter (open data points) and (b) with jet disturber (closed data points) for two different pumping conditions. The 4.0 $\mu$M DDTMA solution was infused at 5.0 $\mu$L/min flow rate and the inlet ion current to the ion funnel was 4.3±0.3 nA.
Figure 3:
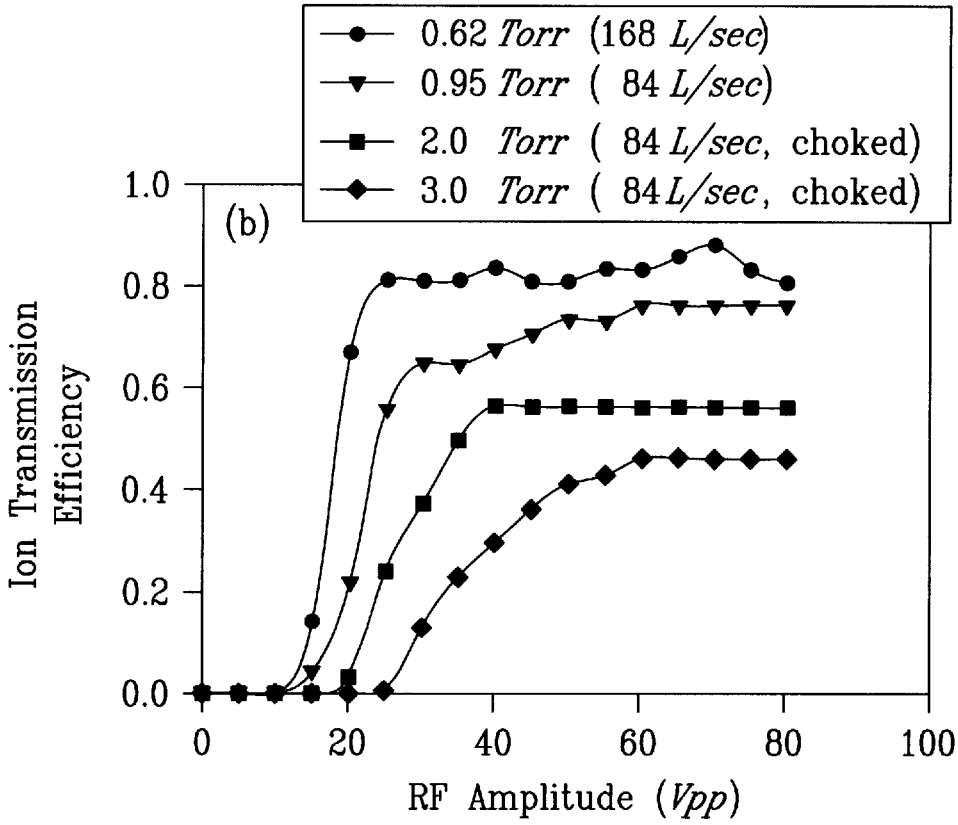

FIG. 3 shows the ion transmission efficiency through the ion funnel using the seven-capillary inlet as a function of ion funnel RF amplitude at two different pumping speeds for ion funnel with and without the jet disturber. The inlet ion current was 4.3±0.3 nA for all experiments. The results using the jet disturber show that the ion transmission through the ion funnel increases with increasing RF amplitude to a level where over 80% of the inlet current is transmitted, and the transmission efficiency decreases as the pressure increases. Measurements without the jet disturber show similar trends but transmission increases more slowly as RF amplitude increases and the maximum transmissions were lower than those with the jet disturber. The observed transmission trend is typical for an RF ion guide; at first the ion transmission increases with increasing RF amplitude due to the increased pseudo-potential of the trapping field. Transmission then decreases at higher RF amplitude due to the unstable trajectories or RF driven fragmentation of lower m/z ions. This decrease at high RF amplitude was not observed here because the maximum RF amplitude was limited by the RF power circuit, but was previously observed with a similarly configured ion funnel operating at a lower RF frequency with the same sample.

Comparing the ion transmission values at optimal RF amplitude to those obtained at zero RF amplitude demonstrates the effectiveness of the ion funnel. The ion transmission without jet disturber (open data points) clearly shows that the transmitted ion current at zero RF amplitude is well below that realized at optimal RF amplitudes (i.e. at 40–80 V). That demonstrates that the ion transmission through the ion funnel is a result of ion confinement due to the RF electric field. The ratio of transmitted ion current to the neutral gas transmission is higher than in a conventional (orifice-skimmer or capillary-skimmer) interface. The ion transmission with the jet disturber in FIG. 3 (filled data points), at zero RF amplitude was significantly lower. Ion transport by gas drag is negligible because of the reduced directed gas flow at the bottom of the ion funnel, and transport by the dc field was also negligible. The lower ion transmission with the jet disturber at zero RF amplitude (compared to that without the jet disturber) also indicates that the jet disturber effectively disperses the directed gas flow. FIG. 3 also shows both more effective ion transmission and transmission at low RF amplitudes using the jet disrupter increases at a fixed pressure in the ion funnel chamber.

Figure 4:
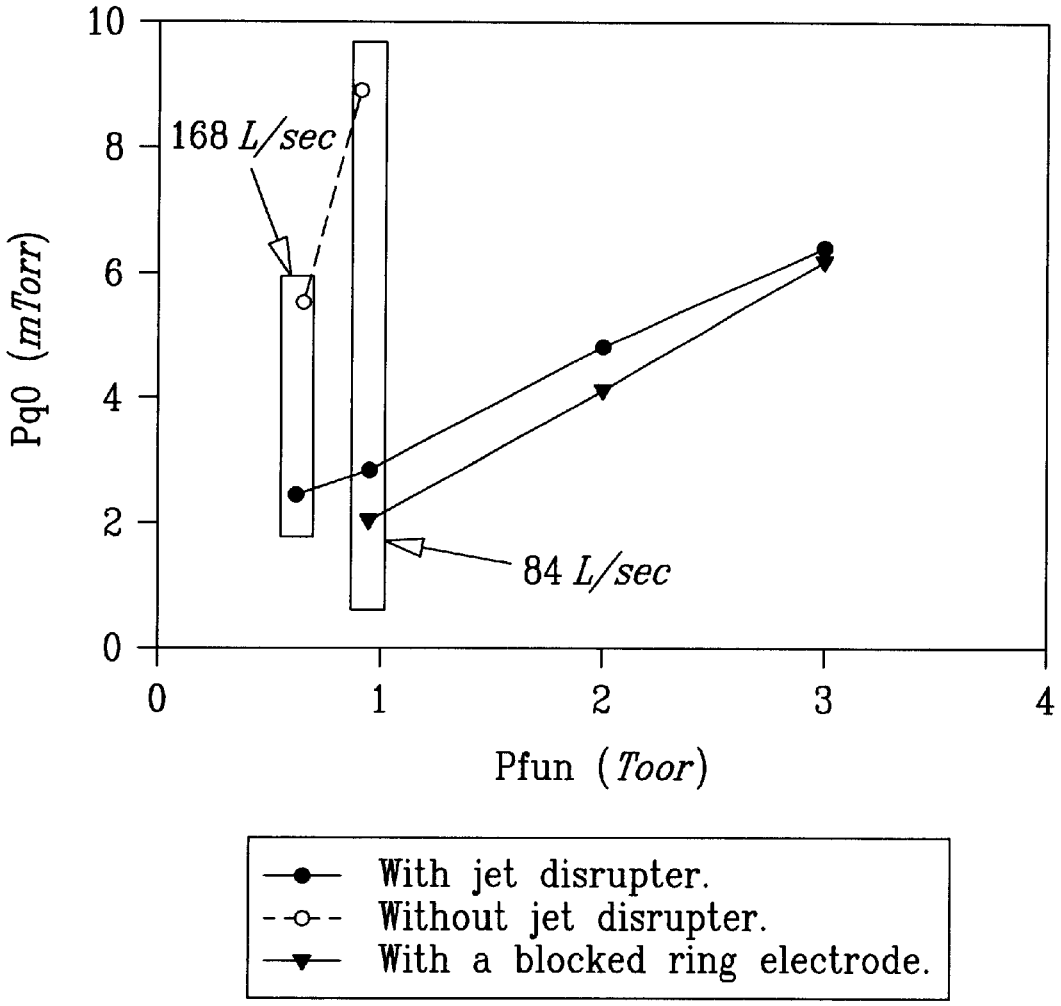
FIG. 4 is a graph of the Q0 chamber pressure as a function of ion funnel chamber pressure.

With no directed gas stream, the gas flow to the second chamber should be determined purely by the difference in the chamber pressures and conductance between the first and the second vacuum chamber. FIG. 4 shows the second chamber pressure variation as a function of the first chamber pressure for different jet disturber configurations. It shows that, with the 9 mm o.d. disk jet disturber, the second chamber pressure was reduced by a factor of 2 to 3 compared to the pressure without the jet disturber (for a first chamber pressure range from 0.6 Torr to 1 Torr). Importantly, the second chamber pressure increases much more slowly with the jet disturber than without the disturber as the first chamber pressure increases. This clearly shows that without the jet disturber, the jet stream is not completely dispersed at the bottom of the ion funnel. For 1 Torr ion funnel chamber pressure, the second chamber pressure with the 9 mm disk was only 1.5 times greater than that with complete jet dispersion obtained with a metal sheet blocking a ring electrode opening. In contrast, the pressure in the second chamber pressure without the jet disturber was 4.5 times higher than that with complete blockage of the jet. Therefore, if the first chamber pressure is maintained as constant, the pumping requirement for the second chamber will be reduced by 2 to 3 times when the jet disturber is used. On the other hand, if the second chamber pressure is maintained at the maximum pressure (10 m Torr) permitted by the turbo pump, FIG. 4 shows that the first vacuum (ion funnel) chamber should be operated at a pressure lower than ~1 Torr without jet disturber. With the jet disturber, the first vacuum chamber could be operated at a pressure higher than 3 Torr. Therefore, if the second chamber is maintained at constant pressure, the pumping requirement of the first stage can be reduced by factor of more than 3 with the jet disturber. Of course, this reduced requirement is based on the pumping consideration only. If the ion transmission efficiency through the ion funnel is considered, the optimum needs to accounts for the pressure dependence of ion transmission through the ion funnel. The jet disturber allows either a reduction in pumping speed or an increase in gas load from the ion source.

Figure 5:
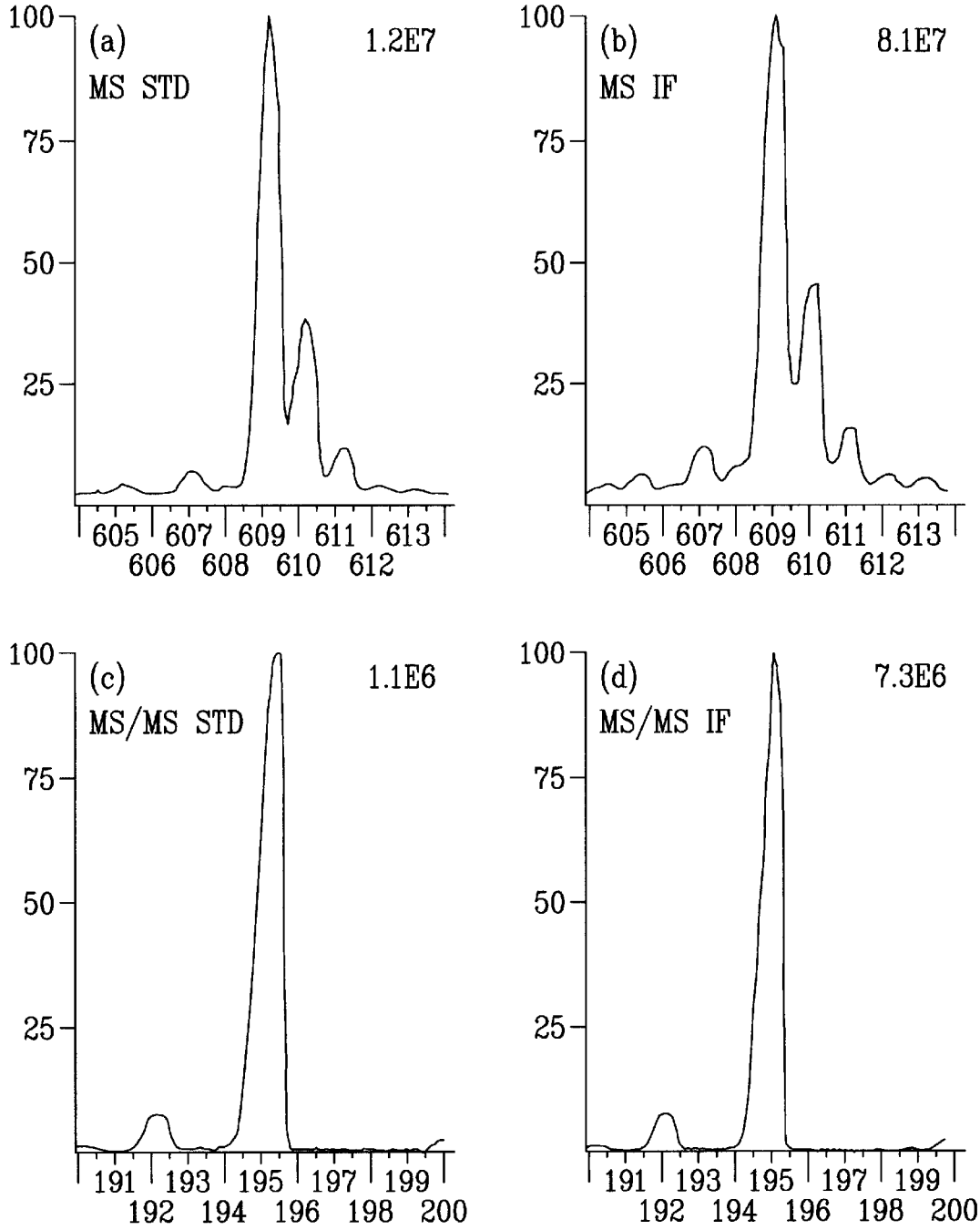
FIG. 5 is the spectra of reserpine in concentration of 100 pg/ul (10 scan). Mass spectrum (a) with standard interface (b) with the new interface (of multicapillary and jet disturber equipped ion funnel). MS/MS (c) with standard interface and (d) the new interface.

The transmission efficiency of the ions through the ion funnel was measured as a function of RF amplitude at pressures up to 3.0 Torr with the jet disturber and up to 1.0 Torr with and without the jet disturber (FIG. 3). The maximum transmission decreases as the chamber pressure increases. In FIG. 3, a decrease of ion transmission efficiency at increased pressure was also observed without the jet disturber (FIG. 3 open data points) and with the jet disturber. This indicates that the decreased ion transmission efficiency at higher pressure was not caused primarily by the jet disturber, but by the decreased effective RF field confining effect at least for chamber pressure up to 1 Torr. In FIG. 5, the decreasing ion transmission with the jet disturber at pressures higher than 1 Torr support this view, indicating ion losses to the jet disturber is not the major factor of the reduced transmission efficiency at higher pressure.

Mass spectra of four different sample solutions were acquired with the low pumping speed configuration at an ion funnel chamber pressure of 2.2–2.5 Torr. The MS and MS/MS sensitivities for standards were evaluated and compared to those with the standard configuration of the API 3000.

The MS and MS/MS spectra (sum of 10 scans) for the molecular ion region of reserpine at high concentration are shown in FIG. 5. In those figures, the spectra from the low pumping speed system are the spectra with the seven capillary inlet. The MS spectrum with the low pumping speed configuration demonstrated 6.8 times greater peak intensity than the standard system. The MS/MS spectra of a major fragment with the low pumping speed configuration showed a 6.6 times greater peak intensity than those with the standard system, in good agreement. With the interface incorporating the ion funnel, the ratio of second isotopic peak to the major isotopic peak in MS spectrum is greater (45%) than observed with the standard interface (37%). That indicates the major isotopic peak (count rate) was under estimated due to saturation of the detector.

Figure 6:
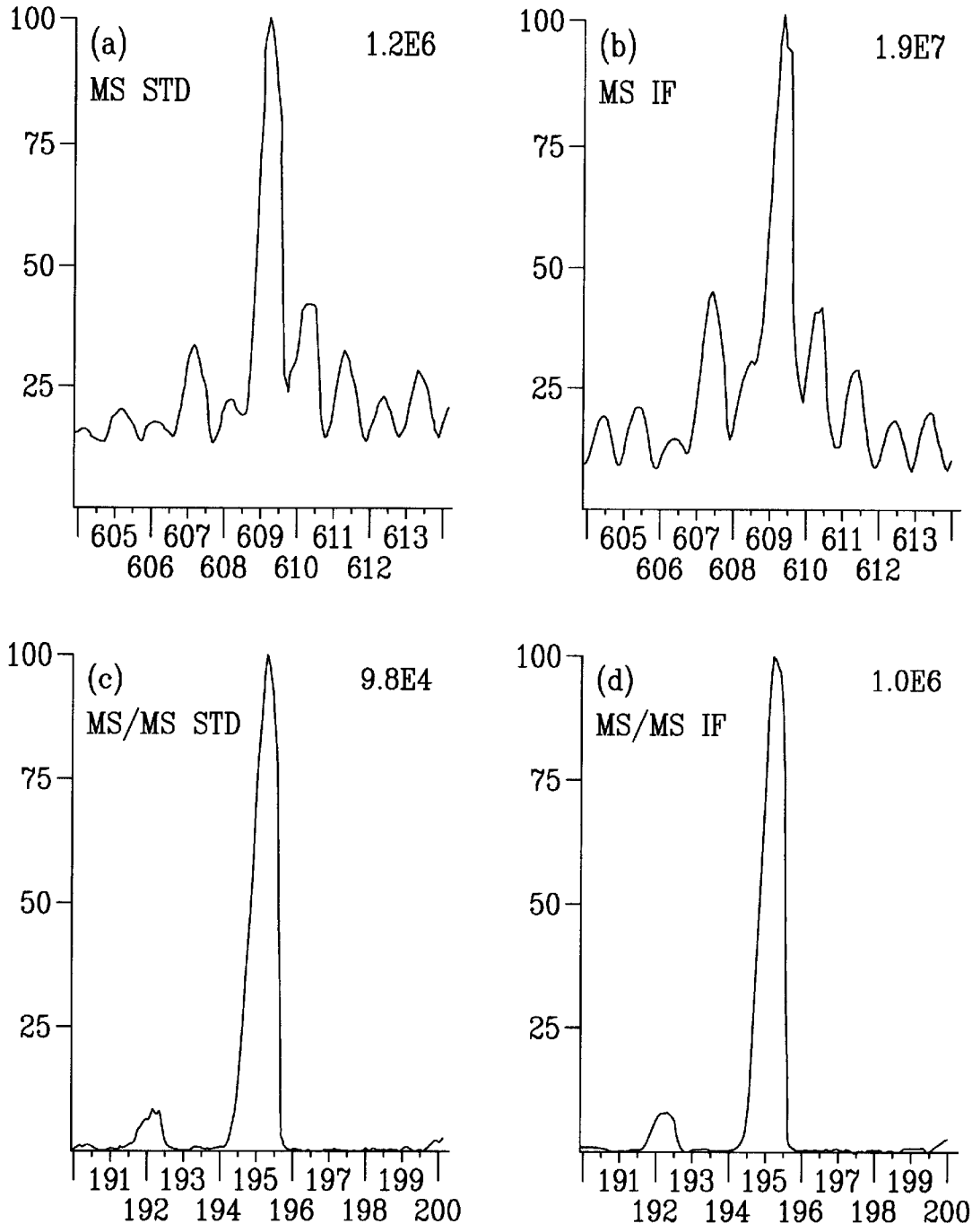
FIG. 6 is the spectra of reserpine in concentration of 10 pg/ul (10 scan). Mass spectrum (a) with standard interface (b) with the new interface. MS/MS (c) with standard interface and (d) the new interface.
Figure 7:
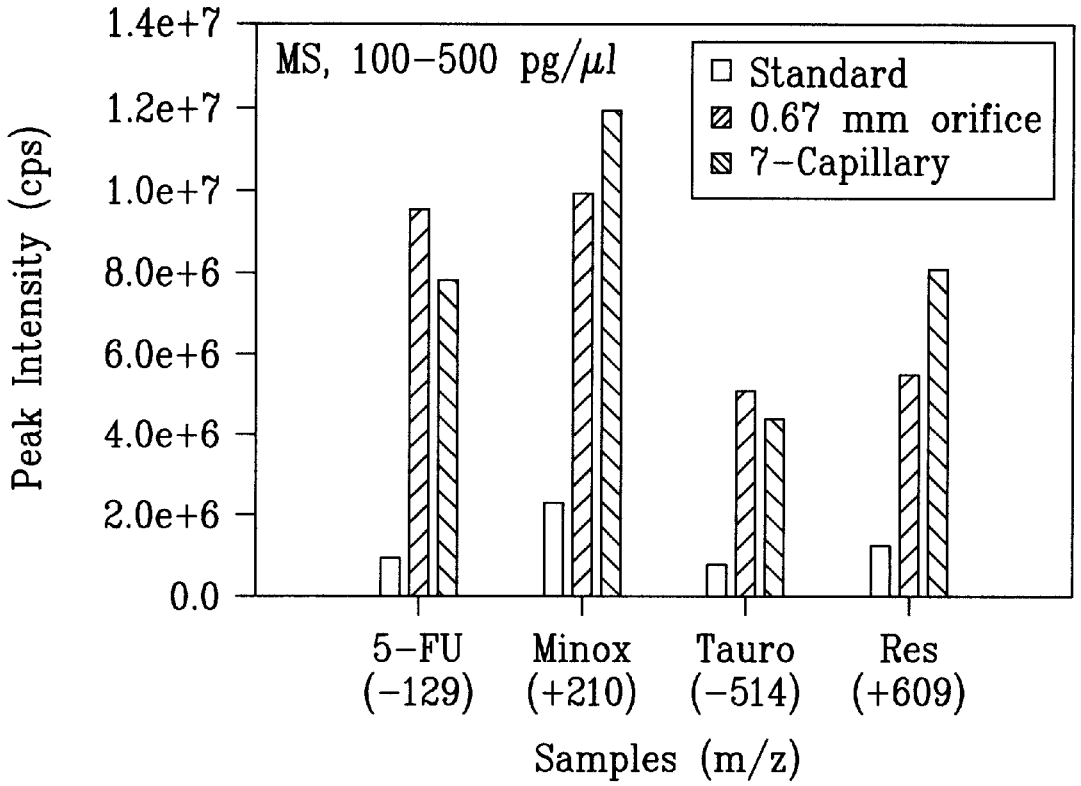
FIG. 7 is a graph showing the peak intensity of MS and MS/MS for four different higher concentration samples with different system configurations (1 scan). The sample concentration: 5-Fu: 500 pg/ul; Minoxidil: 100 pg/ul; Taurocholic acid: 500 pg/ul; Reserpine: 100 pg/ul.
Figure 7:
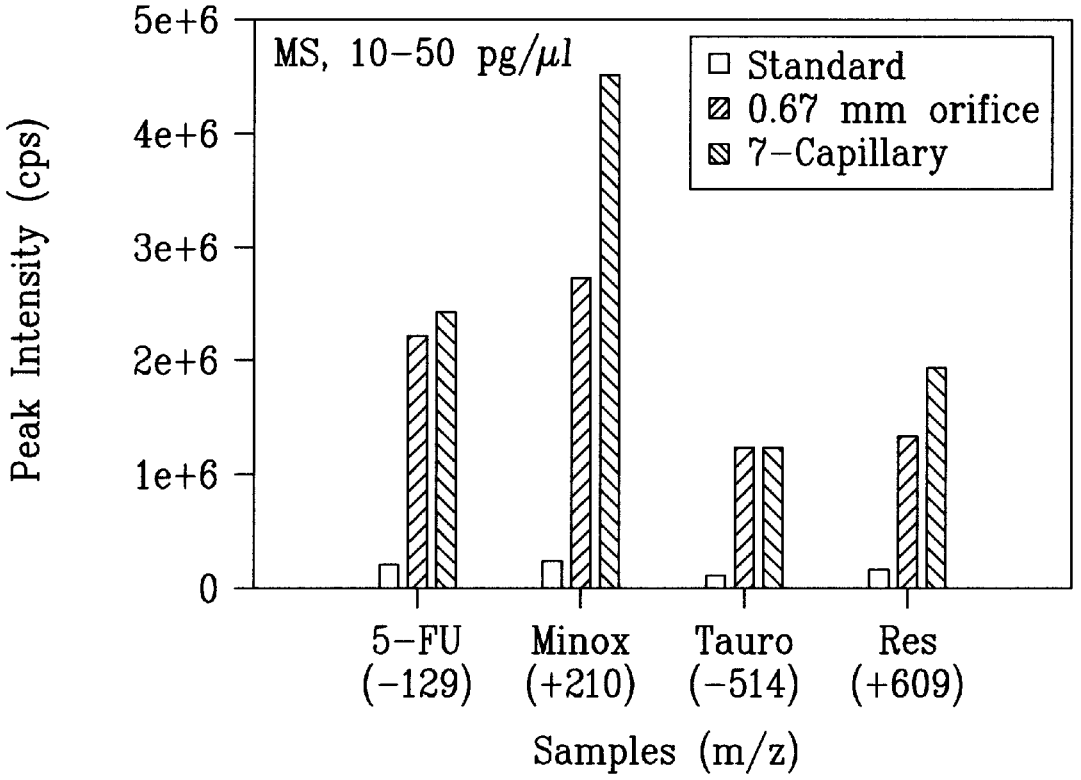

FIG. 6 shows MS and MS/MS spectra obtained for the lower concentration (10 pg/ul) reserpine samples. Although the improved sensitivity with the low pumping speed configuration did not improve the signal to noise ratio (largely due to "chemical noise") in MS mode, the improved sensitivity and signal to noise in MS/MS mode are shown in FIG. 6 (c) and (d). The barely observable noise in MS/MS spectrum with the standard interface configuration indicates that quantifiable differences in MS/MS spectra for samples with one or two order lower sample concentration than the concentrations used are observed.

Figure 8:
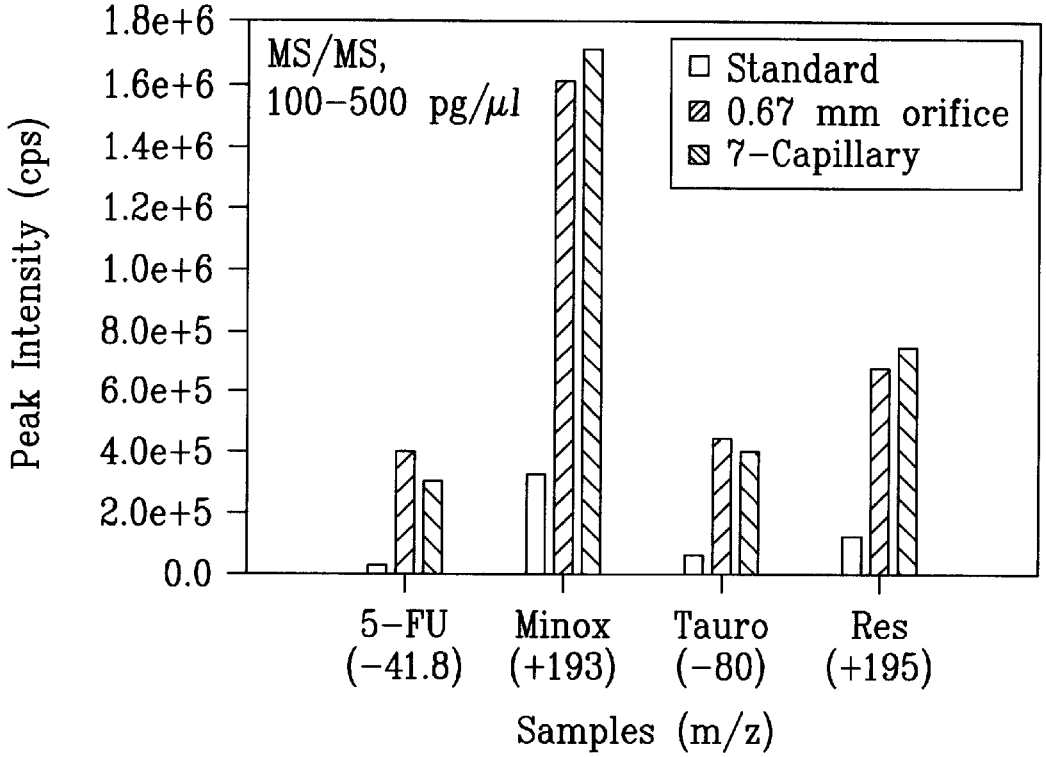
FIG. 8 is a graph showing the peak intensity of MS and MS/MS for four different lower concentration samples with different system configurations (1 scan). The sample concentration: 10 fold dilution from those of FIG. 8.
Figure 8:
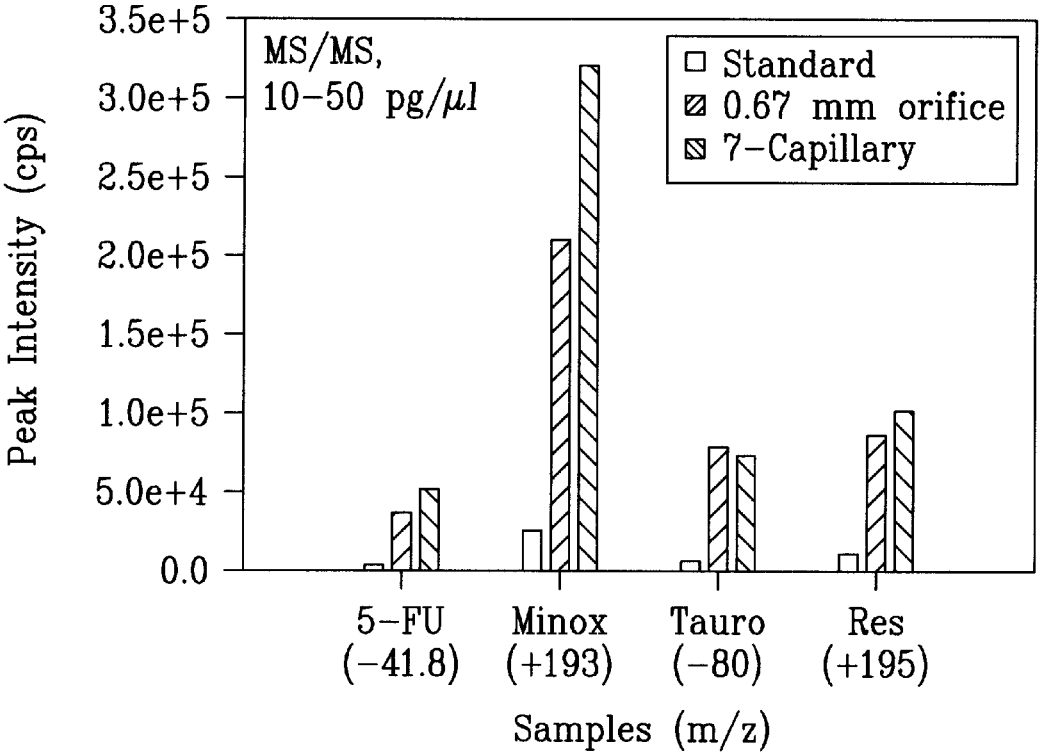

The major peak heights in MS and MS/MS for four different samples at the higher concentrations are compared in FIG. 8. The concentrations were 100 pg/$\mu$l for positive ion mode and 500 pg/$\mu$l for negative ion mode. This comparison shows that with the low pumping speed system the peak heights with the multi-capillary inlet are similar to those with the 0.67 mm orifice inlet. The sensitivity enhancements with the low pumping speed system were calculated by comparing the peak heights to those with the standard system and are summarized in table 2. This table shows that the sensitivity enhancement with the multi-capillary inlet ranged from 5.3 to 10.7 (with the 0.67 mm orifice, 5.3 to 14.3) for MS/MS spectra.

TABLE 2

Sensitivity gain using jet disturber equipped ion funnel for high concentration samples.

| | M/z | Enhancement[a] 0.67 mm orifice[b] | Enhancement[a] Seven capillary[c] |
|---|---|---|---|
| 5-FU | 129.0 | 10.6 | 8.8 |
| 500 pg/ul | 41.8* | 14.3 | 10.7 |
| Minoxidil | 210 | 4.3 | 5.2 |
| 100 pg/ul | 193* | 5.3 | 5.3 |
| Taurocholic | 514 | 6.8 | 5.9 |
| 500 pg/ul | 80* | 8.6 | 7.8 |
| Reserpine | 609 | 4.6 | 6.8 |
| 100 pg/ul | 195* | 6.0 | 6.6 |

[a]compared to the spectrum with Sciex API 3000 standard interface, 0.25 mm orifice.
[b]0.67 mm orifice, mechanical pump (D65B, 22 L/sec), 6 mm curtain plate, ion funnel chamber pressure: 2.2 Torr-, Q0 chamber pressure: 5.4 mTorr
[c]Seven 0.43 × 75 mm capillary, mechanical pump (D65B, 22 L/sec), ion funnel chamber pressure: 2.5 Torr, Q0 chamber pressure: 4.1 mTorr
*a major peak of MS/MS The sensitivity enhancements for four lower concentration samples are shown in FIG. 8 and table 3. These results show the sensitivity enhancement ranging from 10.2 to 14.1 with the multi-capillary inlet (8.4 to 15.1 with the 0.67 mm orifice) for MS/MS spectra. The high chemical noise in the MS spectra overwhelms the sensitivity enhancement at these concentrations. The lower sensitivity enhancements obtained for high concentration samples suggests that space charge effects in the interface region are reducing efficiency for the low pumping speed system. The ion funnel and/or the rf only quadrupole ion guide (Q0) may be subject to the space charge related effects on ion transmission due to the buffer gas cooling in these regions and the resultant low axial ion velocity and higher local density in this regions.

TABLE 3

Sensitivity gain using jet disturber equipped ion funnel for low concentration samples.

| | M/z | Enhancement[a] 0.67 mm orifice[b] | Enhancement[a] Seven capillary[c] |
|---|---|---|---|
| 5-FU | 129.0 | 11.6 | 12.6 |
| 50 pg/ul | 41.8* | 10.0 | 14.0 |
| Minoxidil | 210 | 12.3 | 20.5 |
| 10 pg/ul | 193* | 8.4 | 12.8 |
| Taurocholic | 514 | 16.0 | 16.0 |
| 50 pg/ul | 80* | 15.1 | 14.1 |
| Reserpine | 609 | 10.8 | 15.8 |
| 10 pg/ul | 195* | 8.7 | 10.2 |

[a]compared to the spectrum with Sciex API 3000 standard interface, 0.25 mm orifice.
[b]0.67 mm orifice, mechanical pump (D65B, 22 L/sec), 6 mm curtain plate, ion funnel chamber pressure: 2.2 Torr, Q0 chamber pressure: 5.4 mTorr
[c]Seven 0.43 × 75 mm capillary, mechanical pump (D65B, 22 L/sec), ion funnel chamber pressure: 2.5 Torr, Q0 chamber pressure: 4.1 mTorr
*a major peak of MS/MS In this work a 10-fold sensitivity enhancement was obtained using the low pumping speed configuration compared to the standard system of the API 3000. The standard interface uses a relatively large skimmer opening (2.6 mm) with a 0.25 mm orifice inlet. The transmission efficiency through the skimmer (from the first vacuum stage to the second vacuum stage) can be greater than 75% for 4 $\mu$M DDTMA solutions in 100% acetonitrile. In these experiments, the sensitivity enhancement was demonstrated to be higher than 10 with the low pumping speed configuration using an inlet having a seven-fold higher conductance compared to that of the standard interface. Assuming the ion transmission through an orifice inlet is proportional to the gas conductance, these results indicate the ion transmission through the jet disturber equipped ion funnel is close to 100%.

CLOSURE

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A method for introducing charged particles into a device comprising the steps of:

a) generating ions in a relatively high pressure region external to the device and b) directing said ions through at least one aperture extending into the device, and c) further directing said ions through an ion funnel within the interior of the device having a jet disturber positioned within said ion funnel.

2. The method of claim 1 wherein the device is provided as a mass spectrometer.

3. The method of claim 1 wherein the at least one aperture is a multicapillary inlet.

4. The method of claim 1 wherein said relatively high pressure region is at between $10^{-1}$ millibar and 1 bar.

5. The method of claim 1 wherein the charged particles are generated with an electrospray ion source.

6. An apparatus for introducing charged particles generated at a relatively high pressure into a device maintained at a relatively low pressure comprising an ion funnel having a jet disturber positioned within said ion funnel.

7. The apparatus of claim 6 further comprising a multicapillary inlet extending into the device, whereby charged particles generated in the relatively high pressure region move through the multicapillary inlet and into the ion funnel.

8. The apparatus of claim 6 wherein the device is a mass spectrometer.

9. The apparatus of claim 6 wherein said relatively high pressure region is at between $10^{-1}$ millibar and 1 bar.

10. The apparatus of claim 7 further comprising an electrospray ion source interfaced with the plurality of apertures.

* * * * *